US009459042B2

(12) United States Patent
Chantant et al.

(10) Patent No.: US 9,459,042 B2
(45) Date of Patent: Oct. 4, 2016

(54) METHOD OF PRODUCING A GASIFIED HYDROCARBON STREAM; METHOD OF LIQUEFYING A GASEOUS HYDROCARBON STREAM; AND A CYCLIC PROCESS

(75) Inventors: Francois Chantant, The Hague (NL); Wiveka Jacoba Elion, The Hague (NL); Casper Krijno Groothuis, The Hague (NL)

(73) Assignee: Shell Oil Company, Houston, TX (US)

( * ) Notice: Subject to any disclaimer, the term of this patent is extended or adjusted under 35 U.S.C. 154(b) by 1619 days.

(21) Appl. No.: 12/808,769

(22) PCT Filed: Dec. 18, 2008

(86) PCT No.: PCT/EP2008/067814

§ 371 (c)(1),
(2), (4) Date: Sep. 2, 2010

(87) PCT Pub. No.: WO2009/080678

PCT Pub. Date: Jul. 2, 2009

(65) Prior Publication Data

US 2010/0319361 A1 Dec. 23, 2010

(30) Foreign Application Priority Data

Dec. 21, 2007 (EP) ..... 07123905

(51) Int. Cl.
*F25J 1/02* (2006.01)
*F25J 1/00* (2006.01)

(52) U.S. Cl.
CPC ..... *F25J 1/005* (2013.01); *F25J 1/0015* (2013.01); *F25J 1/0022* (2013.01); *F25J 1/0072* (2013.01);

(Continued)

(58) Field of Classification Search
CPC ..... F25J 1/0015; F25J 1/005; F25J 1/0022; F25J 1/0072; F25J 1/004
USPC ..... 62/50.2, 53.2, 606, 611, 612, 614
See application file for complete search history.

(56) References Cited

U.S. PATENT DOCUMENTS

| | | | | |
|---|---|---|---|---|
| 2,975,604 | A | 3/1961 | McManhon | 62/9 |
| 3,018,632 | A | 6/1962 | Keith | 62/9 |

(Continued)

FOREIGN PATENT DOCUMENTS

| | | | |
|---|---|---|---|
| EP | 1469265 | 10/2004 | F25J 1/02 |
| GB | 937999 | 9/1963 | |

(Continued)

OTHER PUBLICATIONS

Smith, D.; Eriksson, L.; Pehrsson, L.O.; Strom-Olsen, H. Cold box shuttle—a system for the recovery of offshore gas—applied to Sweden. Soc. Pet. Eng. AIME, Pap. v4:OTC-4401 (Jan. 1, 1982): 277-287.*

(Continued)

*Primary Examiner* — Frantz Jules
*Assistant Examiner* — Brian King

(57) ABSTRACT

A first liquefied hydrocarbon stream is provided from a first source and a second liquefied hydrocarbon stream is provided from a second source. The second liquefied hydrocarbon stream has been liquefied by cooling solely against a first cooled nitrogen-based stream. The first and second liquefied hydrocarbon streams are gasified to produce a gasified hydrocarbon stream, thereby cooling a gaseous nitrogen-based stream against the gasifying first and second liquefied hydrocarbon streams to provide a second cooled nitrogen-based stream.

17 Claims, 3 Drawing Sheets

(52) U.S. Cl.
CPC ..... *F25J 1/0204* (2013.01); *F25J 1/0223* (2013.01); *F25J 1/0269* (2013.01); *F25J 2210/02* (2013.01); *F25J 2210/42* (2013.01); *F25J 2210/62* (2013.01); *F25J 2290/62* (2013.01)

(56) References Cited

U.S. PATENT DOCUMENTS

| | | | | |
|---|---|---|---|---|
| 3,400,547 | A | 9/1968 | Williams et al. | 62/55 |
| 5,137,558 | A * | 8/1992 | Agrawal | 62/612 |
| 5,139,547 | A * | 8/1992 | Agrawal et al. | 62/616 |
| 5,141,543 | A * | 8/1992 | Agrawal et al. | 62/612 |
| 6,546,739 | B2 * | 4/2003 | Frimm et al. | 62/50.2 |
| 6,598,423 | B1 * | 7/2003 | Emmer et al. | 62/614 |

FOREIGN PATENT DOCUMENTS

| | | | |
|---|---|---|---|
| GB | 1170329 | 11/1969 | |
| GB | 1376678 | 12/1974 | F25J 1/02 |
| GB | 2172388 | 9/1986 | F25J 1/00 |
| JP | 08-282787 A | 10/1996 | |

OTHER PUBLICATIONS

Cold box shuttle may solve economics of marginal gas condensate fields. Ocean Ind. v17:4 (Apr. 1, 1982): 317.*

Haines, G.H.; Thompson, J. Offshore gas liquefaction without offshore LNG plants. Oil Gas J. v78 (Feb. 18, 1980): 87-91.*

Kirillov, N. G. Analysis of Modern Natural Gas Liquefaction Technologies. Chemical and Petroleum Eng. v40:7 (Jul. 1, 2004): 401-406.*

* cited by examiner

METHOD OF PRODUCING A GASIFIED HYDROCARBON STREAM; METHOD OF LIQUEFYING A GASEOUS HYDROCARBON STREAM; AND A CYCLIC PROCESS

CROSS REFERENCE TO EARLIER APPLICATIONS

The present application is a national stage application of International application No. PCT/EP2008/067814, filed 18 Dec. 2008, which claims priority to European Patent Application No. EP 07123905.7, filed 21 Dec. 2007.

FIELD OF THE INVENTION

In one aspect, the present invention relates to a method of producing a gasified hydrocarbon stream. In another aspect, the present invention relates to a method of liquefying a gaseous hydrocarbon stream. In still another aspect, the invention relates to a cyclic process wherein cooling and rewarming a nitrogen-based stream and wherein liquefying and regasifying a hydrocarbon stream.

BACKGROUND OF THE INVENTION

A commonly traded liquefied hydrocarbon stream contains, or essentially consists of, liquefied natural gas (LNG).

Natural gas can be stored and transported over long distances more readily as a liquid than in gaseous form because it occupies a smaller volume and does not need to be stored at high pressures.

Especially for long distance transportation, the liquefied natural gas can be carried in a sea-going vessel between, for example, an export terminal and an import terminal. At an import terminal, the LNG is regasified, and the cold energy can be used to help liquefy nitrogen gas. On its return journey, the sea-going vessel can transport the liquid nitrogen, whose cold energy can then be used in the liquefaction of natural gas.

GB 2 172 388 A describes using liquefied natural gas that has been liquefied off-shore at the wellhead, to liquefy nitrogen in a land-based import plant. The same vessel is used to transport liquefied nitrogen and liquefied natural gas in opposite directions between the land-based plant and the off-shore wellhead.

However, a problem with GB 2 172 388 A is that a small recycling refrigerating liquefaction plant is necessary at the wellhead to top-up the cooling effect of the nitrogen. It appears quite inconvenient to operate and/or maintain such a recycling refrigerating liquefaction plant at such an inconvenient location as an offshore wellhead.

SUMMARY OF THE INVENTION

The present invention provides a method of producing a gasified hydrocarbon stream, at least comprising the steps of:

(a) providing a first liquefied hydrocarbon stream from a first source;

(b) providing a second liquefied hydrocarbon stream from a second source, which second source is at a geographically separate location from the first source and which second liquefied hydrocarbon stream has been liquefied by cooling solely against a first cooled nitrogen-based stream;

(c) gasifying the first and second liquefied hydrocarbon streams to produce a gasified hydrocarbon stream, wherein cooling a gaseous nitrogen-based stream against the gasifying first and second liquefied hydrocarbon streams to provide a second cooled nitrogen-based stream.

The present invention also provides a method of liquefying a gaseous hydrocarbon stream, at least comprising the steps of:

(a) providing a first cooled nitrogen-based stream;

(b) liquefying a hydrocarbon stream solely by cooling against the first cooled nitrogen-based stream to provide a liquefied hydrocarbon stream;

wherein the first cooled nitrogen-based stream has been obtained from a gaseous nitrogen-based stream that has been cooled against a first liquefied hydrocarbon stream provided from a first source and against a second liquefied hydrocarbon stream provided from a second source, during which cooling the first and second liquefied hydrocarbon streams have been gasified, which second source is at a geographically separate location from the first source and which second liquefied hydrocarbon stream has been liquefied by cooling solely against a second cooled nitrogen-based stream.

The present invention also provides a cyclic method process for cooling and warming a nitrogen-based stream and for liquefying and gasifying of a hydrocarbon stream, comprising the steps of:

(a) at a first export location, liquefying a first gaseous hydrocarbon stream to produce a first liquefied hydrocarbon stream; (b) at a second export location, being geographically separate from the first export location, importing a cooled nitrogen-based stream which has been produced at an import location in step (e); (c) at the second export location, liquefying a second gaseous hydrocarbon stream solely by cooling against the cooled nitrogen-based stream to produce a second liquefied hydrocarbon stream; (d) at the import location, importing the first and the second liquefied hydrocarbon streams which have been produced at the first and second export locations in steps (a) and (c) respectively; (e) at the import location, cooling a nitrogen-based gaseous stream against the first and second liquefied hydrocarbon streams imported in step (d), thereby producing the cooled nitrogen-based stream and a gasified hydrocarbon stream; and (f) transporting the cooled nitrogen-based stream to the second export location.

BRIEF DESCRIPTION OF THE DRAWINGS

Embodiments of the present invention will now be described by way of example only, and with reference to the accompanying non-limiting drawings in which.

For the purpose of this description, a single reference number will be assigned to a line as well as a stream carried in that line. Same reference numbers refer to similar components.

DETAILED DESCRIPTION OF THE INVENTION

Figure 1:
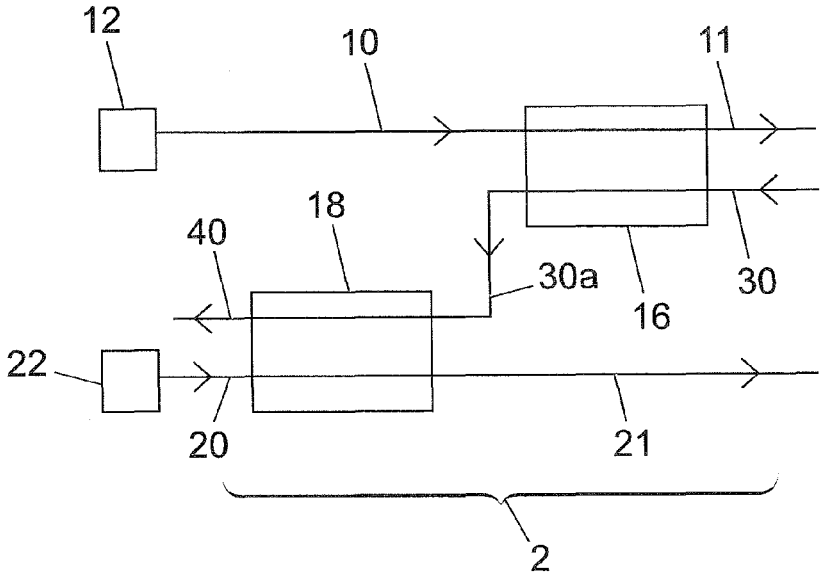
FIG. 1 is a first scheme of a method of cooling a gaseous nitrogen-based stream according to a first embodiment of the present invention.

The present application discloses a method for cooling a gaseous nitrogen-based stream, particularly against one or more liquefied hydrocarbon streams.

It is presently proposed to use the aggregate cold vested in liquefied hydrocarbon streams from least two geographically separate sources, which is released when gasifying these liquefied hydrocarbon streams, to produce a cooled nitrogen-based stream, which may be used at one of the sources to produce at least one of the liquefied hydrocarbon streams.

Applicants have found that using liquefied hydrocarbon streams from more than one source can offer the possibility to produce enough of the cooled nitrogen-based stream to be able to produce at least one of the two liquefied hydrocarbon streams in one of the geographical sources without an additional refrigerant cycle.

Applicants have found that such operation is optimized when the mass ratio of the additional liquefied hydrocarbon streams to the second liquefied hydrocarbon stream which has been fully liquefied using the cooled nitrogen-based stream, is in the range of from 2:1 to 8:1.

Herewith, a relatively simple liquefaction process can be maintained in at least one of the geographical locations, which does not need an additional refrigeration source such as a recycling refrigerant. This geographical location could therefore be in a remote and/or a location that is difficult to service.

It is envisaged that the present methods can be used to monetize so-called stranded gas.

The present invention is based on the insight that, it is dictated by thermodynamics that most of the duty required for liquefying nitrogen needs to be removed at a lower temperature level than the typical temperature of liquefied natural gas at ambient pressure. Thus, the liquefied natural gas by itself cannot liquefy the desired amount of nitrogen and it is generally required to provide a lot of additional cooling in an additional cooling cycle at the land-based plant, or to provide a heat pump, which is generally inefficient.

It is presently proposed to use liquefied hydrocarbon streams (e.g. in the form of LNG) from at least two geographically separate sources to cool, preferably liquefy, a smaller amount of nitrogen, which can then be shipped to one of the two sources to cool a gaseous hydrocarbon stream to produce the liquefied hydrocarbon stream.

This allows a greater mass of LNG to be used, which is capable of releasing greater cooling duty at a particular temperature than only the mass of LNG that is available from the source to which the liquefied nitrogen is transported. With the combined mass of LNG from multiple sources, less or even no additional cooling duty is required at the import location of the LNG.

A sustainable operation is provided if the mass of the produced second cooled nitrogen-based stream using the cold from the first and second liquefied hydrocarbon streams is at least as high as the mass of the first cooled nitrogen-based stream used to produce the second liquefied hydrocarbon stream.

A transport vessel can only carry the same volume of liquefied natural gas from an export location to an import location, as that it can carry liquefied nitrogen. The inventors of the present invention have found that the amount of work that needs to be added to the cooling duty available in the LNG from one source, in order to produce the same volume of liquefied nitrogen to be shipped back to that source to be used to cool and liquefy that volume of LNG, is higher than the amount of work required to liquefy that volume of LNG. Thus the scheme of GB 2 172 388 A is not expected to save any energy.

The proposed use of multiple sources of LNG to produce the cooled, preferably liquefied, nitrogen-based stream needed to produce the LNG in fewer sources is now proposed, so that more cooling duty is available in the form of LNG. Of course, the additional work is now put in to liquefy natural gas or other hydrocarbons at the other LNG sources, but this LNG needs to be produced anyway in order to be able to provide the import location with natural gas. The invention thus saves energy in that the additional cooling duty and equipment, which are otherwise needed to produce enough liquid nitrogen at the import location, is reduced.

FIG. 1 shows a first scheme of a method of cooling a gaseous nitrogen-based stream in part of a LNG regasification facility 2.

LNG is an example of a liquefied hydrocarbon stream suitable for the present invention, although other liquefied hydrocarbon streams exist. The nature of liquefied hydrocarbon streams, in particular LNG, is known in the art. LNG is commonly a product of a natural gas liquefaction plant, which is able to liquefy to natural gas to a temperature below −150° C. at atmospheric pressure. Liquefaction of natural gas using one or more refrigerants and refrigeration cycles is a well known process in the art.

Commonly it is desired to transport liquefied hydrocarbon streams such as LNG over a long distance, usually to a location where the liquefied hydrocarbon stream can be regasified and then used or piped to users. Long distance transportation is commonly carried out in a sea-going vessel from a source to a regasification facility.

A source of a liquefied hydrocarbon stream may be any facility, plant, depot or unit. This includes a plant where the liquefied hydrocarbon stream is provided from a gaseous stream, such as a LNG liquefaction plant, as well as a liquefied hydrocarbon stream storage or distribution port. Such a source may be off-shore, but is typically on-shore, and more typically it is or includes an export terminal. Export terminals for liquefied hydrocarbon streams such as LNG are well known in the art.

Gasifying or regasifying a liquefied hydrocarbon stream can be carried out at any suitable facility, plant or unit, commonly termed a "regasification facility". Such facilities are well known in the art, and are usually geographically separate from a source of a liquefied hydrocarbon stream. Commonly, a regasification facility is across water from a liquefied hydrocarbon stream source. One example of a regasification facility is an import terminal.

A regasification facility, especially an import terminal, generally comprises one or more storage tanks able to receive and store, long term or short term, a liquefied hydrocarbon stream such as LNG.

A gaseous nitrogen-based stream to be cooled by the present invention comprises >60 mol % nitrogen. Such streams include pure nitrogen gas, air, and flue gases comprising nitrogen. Thus, the gaseous nitrogen-based stream may be provided directly from a source, or is provided as a fraction from a nitrogen-source stream such as air. The provision of a gaseous nitrogen-based stream such as a pure nitrogen stream is known in the art and not further discussed herein.

The cooling of one stream against another stream in the present invention is generally carried out by the passage of the streams through one or more heat exchangers in one or more stages. Suitable heat exchangers are well known in the art, and may be various sizes and/or design. Where two or more heat exchangers are used for cooling, such heat exchangers may be in series, in parallel, or both.

A liquefied hydrocarbon stream may be provided from a gaseous hydrocarbon stream being any suitable hydrocarbon-containing gas stream, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the natural gas stream comprises at least 60 mol % methane, more preferably at least 80 mol % methane.

Depending on the source, the gaseous hydrocarbon stream may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like.

If desired, the gaseous hydrocarbon stream may be pretreated before using it in the present invention. This pretreatment may comprise removal of undesired components such as $CO_2$ and $H_2S$, or other steps such as pre-cooling, pre-pressurizing or the like. As these steps are well known to the person skilled in the art, they are not further discussed here.

Referring to the drawings, FIG. 1 shows a first liquefied hydrocarbon stream 10, preferably LNG, from a first source 12 such as a storage tank or export terminal. The first liquefied hydrocarbon stream 10 is gasified within the LNG regasification facility 2, which gasification includes passing the first liquefied hydrocarbon stream 10 through a first heat exchanger 16 to provide a first gasified hydrocarbon stream 11.

FIG. 1 also shows a second liquefied hydrocarbon stream 20, which may have the same or different inventory to the first liquefied hydrocarbon stream 10, and is again preferably LNG, but is provided from a second source 22 which could be a second storage tank or second export terminal. The second liquefied hydrocarbon stream 20 is gasified in the LNG regasification facility 2, which includes passing it through a second heat exchanger 18 to provide a second gasified hydrocarbon stream 21.

FIG. 1 also shows a gaseous nitrogen-based stream 30, which may consist essentially of nitrogen, which can comprise for example >90 mol %, >95 mol %, >99 mol % nitrogen, or pure nitrogen. The gaseous nitrogen-based stream 30 passes through the first heat exchanger 16, generally in a countercurrent direction to the first liquefied hydrocarbon stream 10, and is cooled thereby to provide a partly-cooled nitrogen-based stream 30*a*, which stream 30*a* then passes through the second heat exchanger 18 against the second liquefied hydrocarbon stream 20, to provide a first or second cooled nitrogen-based stream 40.

Preferably, the first or second cooled nitrogen-based stream 40 is a liquefied nitrogen stream as discussed hereinafter.

Figure 2:
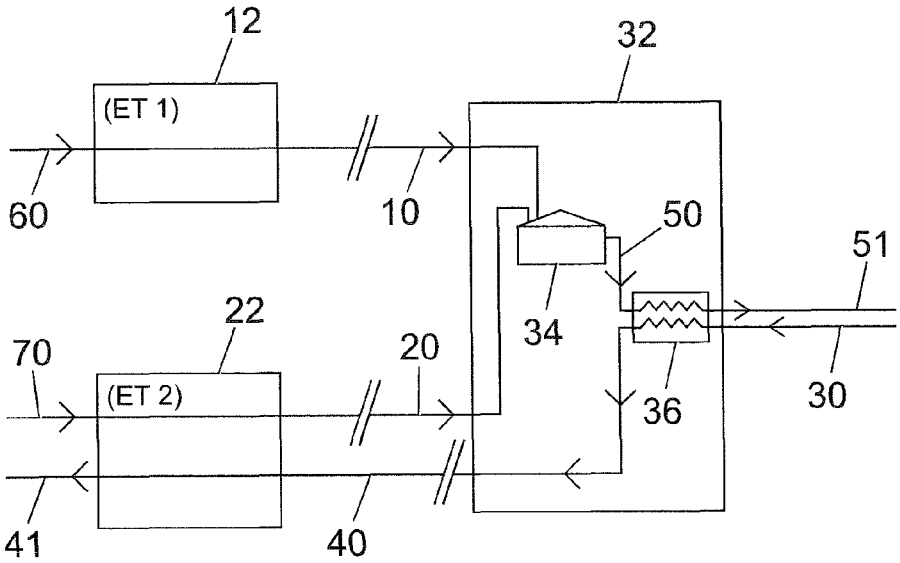
FIG. 2 is a second scheme of a method of cooling a gaseous nitrogen-based stream according to a second embodiment of the present invention.

FIG. 2 shows a second scheme of the present invention. Like FIG. 1, it shows a first liquefied hydrocarbon stream 10, which may be LNG, and a second liquefied hydrocarbon stream 20, which may also be LNG. The first and second liquefied hydrocarbon streams 10, 20 may be the same or different, and even where they are both LNG, they may have the same or different composition and/or inventory.

In FIG. 2, the first liquefied hydrocarbon stream 10 is provided from a first source 12, which is preferably a first export terminal labelled "ET1". The first export terminal ET1 may include or comprise a hydrocarbon liquefaction facility, able to liquefy a gaseous hydrocarbon stream 60 in a manner known in the art. Methods and processes for liquefying a gaseous hydrocarbon stream such as natural gas are well known in the art, and include cooling against one or more refrigerants in one or more cooling stages.

Typically, the first export terminal ET1 is at or near the sea, and is in a location which is geographically separate, usually remote from, the location of regasification of the first liquefied hydrocarbon stream 10. Transportation, such as by a sea-going vessel, is therefore usually required to pass the liquefied hydrocarbon stream 10 from the first export terminal ET1 to the location of regasification, shown in FIG. 2 as an import terminal 32.

The second liquefied hydrocarbon stream 20 is provided from a second source 22, which in FIG. 2 is preferably a second export terminal labelled "ET2". The second liquefied hydrocarbon stream 20 is preferably provided by liquefaction of a second gaseous hydrocarbon stream 70 such as natural gas in a manner hereafter described.

Like the first export terminal ET1, the second export terminal ET2 is commonly in a location geographically separate from, usually remote from, the location of regasification of the second liquefied hydrocarbon stream 20 shown in FIG. 2 as an import terminal 32.

The first and second liquid hydrocarbon stream 10, 20 are provided from separate liquefaction processes, such as separate liquefaction trains in a manner known in the art. The first and second sources 12, 22 are geographically separate. This allows for the first source to be in a more easily accessible or serviceable location than the second source. Alternatively, the separate liquefaction processes may be in the same geographical area or location, but being fed by mutually different reservoirs. This may also be considered to be a form of first source 12 and second source 22 being in geographically separate locations.

FIG. 2 shows an import terminal 32 as a facility for regasification of the first and second liquefied hydrocarbon streams 10, 20. FIG. 2 shows the combination of the first and second liquefied hydrocarbon streams 10, 20 at the import terminal 32 into one or more common storage tanks 34 such as LNG storage tanks known in the art. From the storage tank(s) 34, a combined liquefied hydrocarbon stream 50 is provided for passage through a third heat exchanger 36 in order to pass its cooling, as part of its regasification to provide a combined gasified hydrocarbon stream 51, to a gaseous nitrogen-based stream 30. The third heat exchanger 36 may comprise one or more steps, portions, sections, stages or heat exchangers, the line up, operation and action of which are known to those skilled in the art.

From the third heat exchanger 36, the gaseous nitrogen-based stream 30 is provided as a cooled second nitrogen-based stream 40, preferably a liquefied nitrogen stream.

The cooled nitrogen-based stream 40 is passed to the second export terminal ET2 where it is used as a first cooled nitrogen-based stream by being at least partly, usually fully, gasified to provide an at least partly, usually fully, gasified nitrogen stream 41 and a source of cooling. Preferably, this cooling at least partly, preferably fully, liquefies the second gaseous hydrocarbon stream 70 to provide the second liquefied hydrocarbon stream 20 at the second source 12. The cooling, preferably liquefying, of a gaseous hydrocarbon stream by a cooled, preferably liquid, nitrogen-based stream such as LN2, is known in the art and is not further described herein.

In some situations, there may be provided a fixed, predetermined or arranged volume or amount of the cooled nitrogen-based stream 40, such as liquid nitrogen provided from one or more storage tanks on a sea-going vessel. It is most efficient to be able to replace such volume or amount with as close as possible the same volume or amount of the second liquefied hydrocarbon stream 20, generally within ±10 vol %.

The liquefaction of the second liquefied hydrocarbon stream 20 may be assisted by heat exchange with one or more other refrigerant streams. However, it is intended in the present invention that any cooling provided by such one or more other refrigerant streams is <50%, preferably <40, <30, <20 or even <10% of the cooling required to provide the second liquefied hydrocarbon stream 20. For example, liquid nitrogen is generally at a temperature of below −150° C., such as below −180° C., or even −190° C. Generally, liquid nitrogen is cooler than the liquefaction temperature of natural gas. Preferably, the liquefying of the second gaseous hydrocarbon stream 70 is provided solely by the cooled nitrogen-based stream 40.

In another embodiment of the present invention, >80%, preferably >90%, of the enthalpy difference between the second gaseous hydrocarbon stream 70 provided as the feed stream, and the second liquefied hydrocarbon stream 20, is provided by the cooled nitrogen-based stream 40.

The relative inventory, preferably amount, of the first liquefied hydrocarbon stream 10 and the second liquefied hydrocarbon stream 20 to be gasified to provide the cooling of the gaseous nitrogen-based stream 30, may be any ratio or combination. Preferably, the mass ratio of the first liquefied hydrocarbon stream 10 to the second liquefied hydrocarbon stream 20 in the method of the present invention is in the range 2:1 to 8:1, more preferably in the range 3:1 to 7:1.

Preferably, the mass ratio of the first liquefied hydrocarbon stream 10 to the second liquefied hydrocarbon stream 20 is such that there is provided a sufficient amount or mass of the cooled nitrogen-based stream 40 to be able to substantially, such as >80 mass % or >90 mass %, or fully liquefy the second gaseous hydrocarbon stream 70 to provide the second liquefied hydrocarbon stream 20.

In another way, the method of the present invention gasifies mass X of the first liquefied hydrocarbon stream 10, gasifies mass Y of the second liquefied hydrocarbon stream 20, to provide mass Z of the cooled nitrogen-based stream 40, wherein mass Z of the cooled-nitrogen based stream 40 is able to fully liquefy the second gaseous hydrocarbon stream 70 to provide mass Y of the second liquefied hydrocarbon stream 20.

Figure 3:
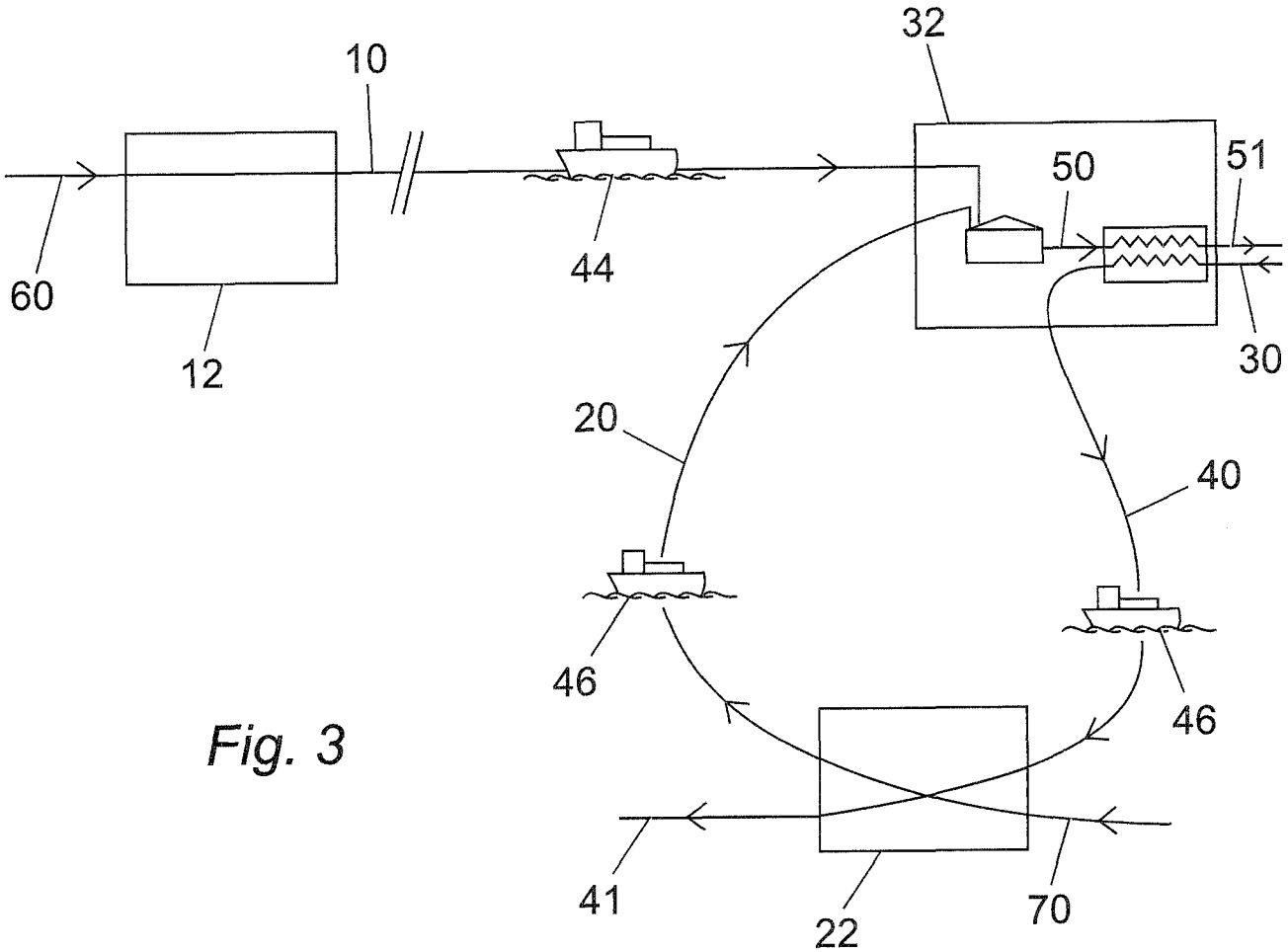
FIG. 3 is a more detailed scheme of FIG. 2.

FIG. 3 is a more detailed representation of FIG. 2. In FIG. 3, there is a representation of a sea-going vessel 14 to illustrate the transportation of the first liquefied hydrocarbon stream 10 from the first source 12 to a regasification location, such as an import terminal 32. Similarly, there is a representation of a second sea-going vessel 46 able to transport the second liquefied hydrocarbon stream 20 from the second source 22 to its place of regasification such as the import terminal 32.

FIG. 3 illustrates a further embodiment of the present invention, being a cyclic process, preferably involving the second sea-going vessel 46. Where the second sea-going vessel 46 is able to transport the second liquefied hydrocarbon stream 20 to the import terminal 32 for cooling the gaseous nitrogen-based stream 30 along with the first liquefied hydrocarbon stream 10, the second sea-going vessel preferably also transports the cooled, preferably liquefied, nitrogen-based stream 40 to the second source 22 to cool the second gaseous hydrocarbon stream 70.

In this way, it can be seen that the present invention is able to provide a cyclic route for the second sea-going vessel 46 between the second source 22 and the import terminal 32.

The second sea-going vessel 46 may comprise more than one vessel where there are a number of such sea-going vessels able to travel between the second source 22 and the import terminal 32. Thus, the cooled nitrogen-based stream 40 may not exactly be carried in the same storage facility and/or on the same sea-going vessel from which the second liquefied hydrocarbon stream 20 was provided, but may be transported in a similar storage facility in a similar sea-going vessel.

It is noted that the first and second liquefied hydrocarbon streams 10, 20 may be combined or otherwise accumulated prior to gasification, and then gasified as a combined stream or as one or more split streams provided therefrom, to cool the gaseous nitrogen-based stream 30.

It is also noted that cooling of the gaseous nitrogen-based stream 30 may occur in one stage or in more than one stage, with the or each stage being provided with any fraction of the first and second liquefied hydrocarbon streams 10, 20 or their combination.

Figure 4:
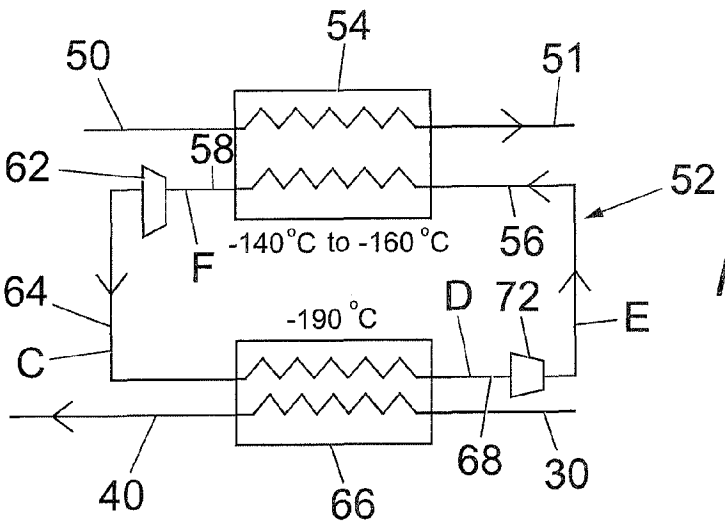
FIG. 4 is a scheme of a nitrogen-cooling cycle usable in the present invention.

FIG. 4 is an example of a nitrogen-refrigerant cooling cycle 52 to show an example of the interaction between a liquefied hydrocarbon stream or streams and a nitrogen-based gaseous stream. FIG. 4 provides an explanation of the benefit of the present invention as illustrated in FIG. 5.

In FIG. 4, the combined liquefied hydrocarbon stream 50 is provided as a representation of the first and second liquefied hydrocarbon streams 10, 20. The combined liquefied hydrocarbon stream 50 passes through a fourth heat exchanger 54 which may comprise one or more heat exchangers in series, parallel or both, in order to provide a combined gasified hydrocarbon stream 51. Also passing through the fourth heat exchanger 54 is a compressed nitrogen-refrigerant stream 56, which can be cooled by the gasification of the combined liquefied hydrocarbon stream 50 in the fourth heat exchanger 54 in a manner known in the art, usually down to a temperature in the range −140° C. to −160° C. This provides a first cooled nitrogen-refrigerant stream 58, which then passes through an expander 62 to provide a cooled expanded nitrogen-refrigerant stream 64 having a temperature below −160° C., such as −190° C. or below. Pure nitrogen gas can be liquefied at −196° C. at atmospheric pressure, and it is the intention of the expanded cooled nitrogen-refrigerant stream 64 to provide the required cooling duty to liquefy a gaseous nitrogen-based stream 30 in a fifth heat exchanger 66. The fifth heat exchanger 66 may comprise one or more heat exchangers in series, parallel or both, and the liquefying a gaseous nitrogen-based stream 30 such as pure nitrogen, to provide a cooled, preferably liquefied, nitrogen-based stream 40, is known in the art. The fifth heat exchanger 66 also provides a warmed nitrogen-refrigerant stream 68, which can then be compressed by one or more suitable compressors 72 to provide the compressed nitrogen-refrigerant stream 56.

Figure 5:
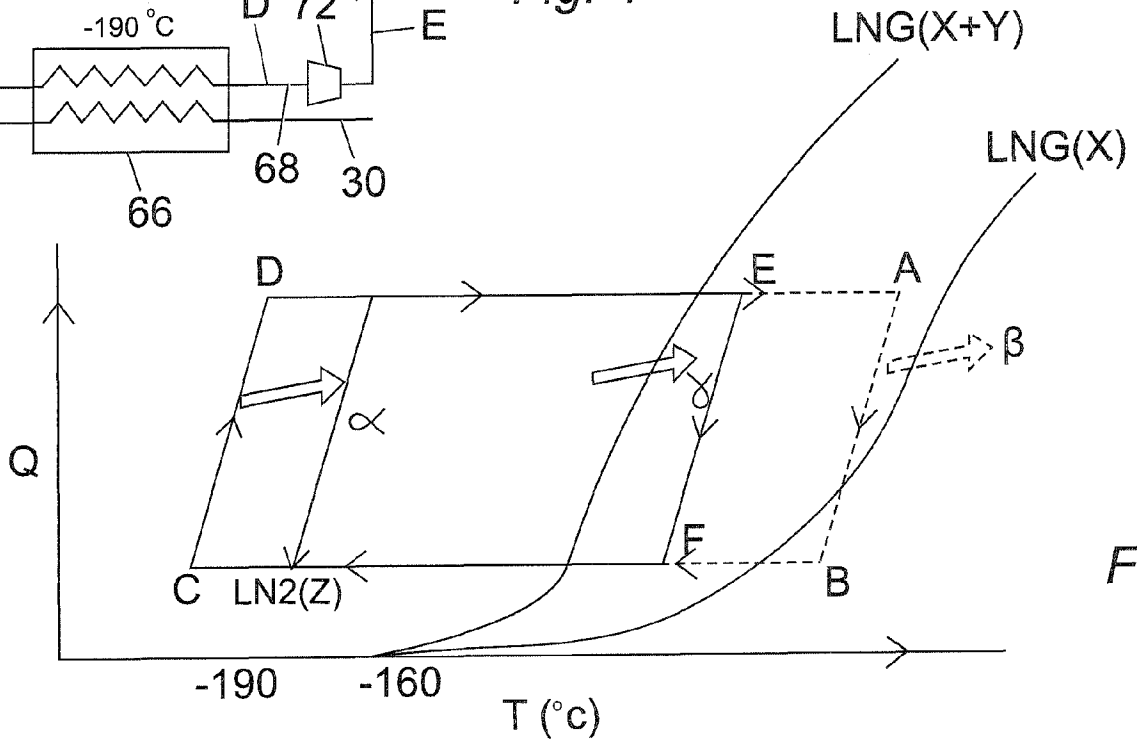
FIG. 5 shows two heating cycles for the nitrogen-cooling cycle in FIG. 4 under two different conditions.

FIG. 5 is a graph of duty (Q) against temperature (T) for the nitrogen-refrigerant cooling cycle 52 shown in FIG. 4.

The general cooling cycle and energy requirements needed to provide a mass Z of LN2 based on a known mass X of regasified LNG is known in the art. This is generally represented in FIG. 5 by the path A-B-C-D. For example, regasification of mass X of LNG from a temperature of approximately −160° C., allows cooling to be provided from the regasified LNG to a nitrogen-refrigerant, thereby extracting heat therefrom (represented by →β) along the line A-B. Expansion of the nitrogen-refrigerant at point B provides the drop in its temperature along line B-C to below −160° C. The passage of the evaporated nitrogen-refrigerant along line C-D allows it to extract heat from a gaseous nitrogen-based stream (→α) to provide a liquefied nitrogen-based stream. For line D-A of the cooling cycle, compression power is required, and this is the 'external make-up power' required to complete the nitrogen-refrigerant cooling cycle.

The present invention provides a nitrogen-refrigerant cooling cycle based on the path EFCD, which points are also shown on the cooling cycle 52 in FIG. 4.

The path of the cooling cycle 52 between E and F is similar to that discussed above for line A-B, wherein gasification of a mass X+Y of LNG is able to extract heat from the nitrogen-refrigerant (→γ), albeit at a lower temperature than for line A-B as discussed hereafter. From point F, the nitrogen refrigerant is expanded to point C, and cooling from the nitrogen refrigerant can then be provided to a gaseous nitrogen-based stream along path C-D to provide a liquefied nitrogen-based stream as discussed hereinabove.

An advantage of the present invention is that recompression of the warmed nitrogen-refrigerant from point D is only required to a point E, rather than to point A as discussed above. This is because the greater mass X+Y of LNG is able to release greater cooling at a particular temperature than only mass X of LNG, such that the required cooling duty (Q) for line E-F can be provided by the mass X+Y of LNG at a lower gasification temperature compared with the gasification of only mass X of LNG. With the mass X+Y of LNG able to cool the nitrogen-refrigerant at a lower temperature, less compression of the nitrogen-refrigerant is required to achieve the same cooling duty at point C, thereby reducing (from point A to point E) the external make-up power required by the compressor (from point D) in the nitrogen-refrigerant cooling cycle 52 useable in the present invention.

Thus, it is an advantage of the present invention to provide a method of cooling a volume of gaseous nitrogen-based stream with reduced external make-up power being required.

It is a further advantage of the present invention to provide use a cooled, preferably liquefied, nitrogen-based stream provided by the above method of the present invention to at least partly, preferably fully, liquefy a gaseous hydrocarbon stream, which can then be used in the cooling of the gaseous nitrogen-based stream.

It is a yet further advantage of the present invention to equate and/or balance the volume or amount of cooled nitrogen-based stream provided by the above method of the present invention with the amount of liquefied hydrocarbon stream provided from the gasification of the cooled nitrogen-based stream.

Thus, the present invention is able to reduce the specific power for a natural gas stream being used to liquefy a gaseous nitrogen-based stream such as nitrogen. That is, to reduce the energy required to liquefy, transport and regasify a mass of natural gas against a gaseous nitrogen-based stream (to help liquefy it), by more efficient use of the energy provided from the liquefied natural gas.

For example, using the arrangement of FIG. 5, and using the line D-A as having a unit length of 1 based on the gasification of mass X of LNG to help liquefy mass Z of gaseous nitrogen, then the addition in the regasification of a second liquefied hydrocarbon stream 20 having an equal mass (i.e. total=X+1Y) is able to reduce the relative length of the line D-A in FIG. 5 to 0.68. That is, line D-E, being the additional make-up compression power required to liquefy the same volume Z of N2, is 32% less than line D-A.

Similarly, the additional use of three times the mass (3Y) of the second liquefied hydrocarbon stream 20 compared to the mass of the first liquefied hydrocarbon stream 10, (i.e. total=X+3Y), is able to reduce the relative length of the line D-A to 0.47. That is, line D-E, being the additional make-up compression power required to liquefy the same volume Z of N2, is now 53% less than line D-A.

A reduction of 32% or 53% in the additional energy required to liquefy the same volume of nitrogen is a clearly a significant energy saving, which can be factored into the overall specific power required for a hydrocarbon stream or streams such as natural gas helping to liquefy a gaseous nitrogen-based stream.

The person skilled in the art will understand that the present invention can be carried out in many various ways without departing from the scope of the appended claims.

We claim:

1. A method of producing a gasified hydrocarbon stream, at least comprising the steps of:

(a) providing a first liquefied hydrocarbon stream from a first source;

(b) providing a second liquefied hydrocarbon stream from a second source, which second source is at a geographically separate location from the first source and which second liquefied hydrocarbon stream has been liquefied by cooling a gaseous source hydrocarbon stream solely against a first cooled nitrogen-based stream;

(c) gasifying the first and second liquefied hydrocarbon streams to produce a gasified hydrocarbon stream, wherein cooling a gaseous nitrogen-based stream against the gasifying first and second liquefied hydrocarbon streams to provide a second cooled nitrogen-based stream wherein the mass of the second cooled nitrogen-based stream produced using cooling duty released from the first and second liquefied hydrocarbon streams is at least as high as the mass of the first cooled nitrogen-based stream used in step (b), whereby no additional cooling duty is used to cool the gaseous nitrogen-based stream and the gaseous source hydrocarbon stream.

2. The method as claimed in claim 1, wherein the first and second cooled nitrogen-based streams are liquefied nitrogen-based streams.

3. The method as claimed in claim 1, wherein the first and second liquefied hydrocarbon streams are combined to form a combined liquefied hydrocarbon stream prior to their gasification.

4. The method as claimed in claim 1, wherein the mass ratio of the first liquefied hydrocarbon stream to the second liquefied hydrocarbon stream is in the range 2:1 to 8:1.

5. The method as claimed in claim 1, wherein the first cooled nitrogen-based stream is at least partly gasified at the second source to provide the source of cooling to liquefy the second hydrocarbon stream.

6. The method as claimed in claim 1, wherein step (a) comprises providing a mass X of the first liquefied hydrocarbon stream; and wherein step (b) comprises providing a mass Y of the second liquefied hydrocarbon stream; and wherein to provide mass Z of the second cooled nitrogen-based stream, wherein the gasifying of the first and second hydrocarbon stream in step (c) produce a mass Z of the second cooled nitrogen-based stream, the mass Z being a sufficient amount to fully liquefy the gaseous source hydrocarbon stream to provide the mass Y of the second liquefied hydrocarbon stream.

7. The method as claimed in claim 1, wherein the first source of the first liquefied hydrocarbon stream is a first export terminal, and the second source of the second liquefied hydrocarbon stream is a second export terminal.

8. The method as claimed in claim 1, wherein steps (a), (b) and (c) are performed at an import terminal.

9. The method as claimed in claim 8, wherein the first liquefied hydrocarbon stream has been transported from the first source to the import terminal by a first vessel, and the second liquefied hydrocarbon stream has been transported from the second source to the import terminal by a second vessel.

10. The method as claimed in claim 9, wherein the second cooled nitrogen-based stream is transported from the import terminal to the second source by the second vessel.

11. The method as claimed in claim 1, wherein the first and second liquefied hydrocarbon streams are liquefied natural gas streams.

12. A method of liquefying a gaseous hydrocarbon stream, at least comprising the steps of:

(a) providing a second cooled nitrogen-based stream;

(b) liquefying a hydrocarbon stream solely by cooling against the second cooled nitrogen-based stream to provide a liquefied hydrocarbon stream; wherein the second nitrogen-based stream has been obtained from a gaseous nitrogen-based stream that has been cooled against a first liquefied hydrocarbon stream provided from a first source and against a second liquefied hydrocarbon stream provided from a second source, during which cooling the first and second liquefied hydrocarbon streams have been gasified, and whereby no additional cooling is used to cool the gaseous nitrogen-based stream, which second source is at a geographically separate location from the first source and which second liquefied hydrocarbon stream has been liquefied by cooling solely against a first cooled nitrogen-based stream, wherein the mass of the first cooled nitrogen-based stream used in step (b) is at most equal to the mass of the second cooled nitrogen-based stream, and no additional cooling is used to liquefy the first cooled nitrogen-based stream.

13. The method as claimed in claim 12, wherein the first and second cooled nitrogen-based streams are liquefied nitrogen-based streams.

14. The method as claimed in claim 12, wherein the gaseous hydrocarbon stream is liquefied to provide the second liquefied hydrocarbon stream of step (b).

15. A cyclic process wherein cooling and re-warming a nitrogen-based stream, and wherein liquefying and regasifying a hydrocarbon stream, comprising the steps of:

(a) at a first export location, liquefying a first gaseous hydrocarbon stream to produce a first liquefied hydrocarbon stream;

(b) at a second export location, being geographically separate from the first export location, importing a cooled nitrogen-based stream which has been produced at an import location in step (e);

(c) at the second export location, liquefying a second gaseous hydrocarbon stream by cooling solely against the cooled nitrogen-based stream to produce a second liquefied hydrocarbon stream, wherein no additional cooling duty is used to liquefy the second gaseous hydrocarbon stream;

(d) at the import location, importing the first and the second liquefied hydrocarbon streams which have been produced at the first and second export locations in steps (a) and (c) respectively;

(e) at the import location, cooling a nitrogen-based gaseous stream against the first and second liquefied hydrocarbon streams imported in step (d), thereby producing the cooled nitrogen-based stream and a gasified hydrocarbon stream, whereby no additional cooling duty is used to cool the nitrogen-based gaseous stream; and (f) transporting the cooled nitrogen-based stream to the second export location, wherein the mass of the cooled nitrogen-based stream produced in (e) using cooling duty released from the first and second liquefied hydrocarbon streams is at least as high as the mass of the cooled nitrogen-based stream used in step (c).

16. The method as claimed in claim 12, wherein the mass ratio of the first liquefied hydrocarbon stream to the second liquefied hydrocarbon stream is in the range 2:1 to 8:1.

17. The method as claimed in claim 12, wherein said liquefying of said hydrocarbon stream in step (b) is performed at the second source, and wherein the first cooled nitrogen-based stream has been produced at an import terminal and transported from the import terminal to the second source by a second vessel, wherein liquefied hydrocarbon stream provided in step (b) is transported to the import terminal by the second vessel.

* * * * *